United States Patent [19]

Scott

[11] Patent Number: 4,793,951

[45] **Date of Patent: * Dec. 27, 1988**

[54] CARBURETOR FUEL PRIMER

[75] Inventor: William A. Scott, Mt. Zion, Ill.

[73] Assignee: Tillotson, Ltd., Tralee, Ireland

[ * ] Notice: The portion of the term of this patent subsequent to Aug. 4, 2004 has been disclaimed.

[21] Appl. No.: 53,327

[22] Filed: May 22, 1987

Related U.S. Application Data

[63] Continuation of Ser. No. 900,435, Aug. 26, 1986, Pat. No. 4,684,485.

[51] Int. Cl.[4] ..... F02M 1/16

[52] U.S. Cl. ..... 261/35; 261/36.2; 261/DIG. 8; 261/DIG. 68

[58] Field of Search ..... 261/DIG. 8, DIG. 68, 261/29, 35, 36.2

[56] References Cited

U.S. PATENT DOCUMENTS

| | | | |
|---|---|---|---|
| 1,591,331 | 7/1926 | Linebarger . | |
| 3,177,920 | 4/1965 | Phillips | 158/36.4 |
| 3,275,305 | 9/1966 | Nutten | 261/34 |
| 3,494,343 | 2/1970 | Nutten | 123/187.5 |
| 4,271,093 | 6/1981 | Kobayashi | 261/34 R |
| 4,335,061 | 6/1982 | Kobayashi | 261/44 G |
| 4,447,370 | 5/1984 | Kobayashi et al. | 261/35 |
| 4,684,484 | 8/1987 | Guntly | 261/DIG. 8 |

*Primary Examiner*—Tim Miles

*Attorney, Agent, or Firm*—Harness, Dickey & Pierce

[57] ABSTRACT

A fuel primer for small internal combustion engines is disclosed. The fuel primer is associated with a metering chamber of a carburetor. The metering chamber includes an inlet port and an outlet port and communicates with both a fuel source and a venturi on the carburetor by conventional means. The primer includes a mechanism which communicates with the restricted inlet port to provide one way flow into the metering chamber. A second mechanism communicates with the unrestricted outlet port to provide one way flow from the metering chamber. A third mechanism associates the first and second one way mechanisms for pressurizing and depressurizing the flow through the primer so that fuel is drawn into the metering chamber from the fuel source.

12 Claims, 1 Drawing Sheet

CARBURETOR FUEL PRIMER

This is a continuation of U.S. patent application Ser. No. 900,435 filed Aug. 26, 1986 entitled "CARBURETOR FUEL PRIMER", now U.S. Pat. No. 4,684,485.

BACKGROUND AND SUMMARY OF THE INVENTION

The present invention relates to carburetors for small internal combustion engines and more particularly, to fuel primers for providing fuel to the metering chamber of the carburetor prior to the starting of the internal combustion engine.

Small internal combustion engines, especially those on chain saws, lawn mowers, trimmers, leaf blowers and the like, generally need to be primed before starting of the engine occurs. Priming is the predrawing of fuel into the metering chamber of the carburetor prior to the starting of the internal combustion engine. Generally, after an internal combustion engine has sat for a long perior of time, e.g. two weeks or greater, fuel in the metering chamber evaporates. This evaporation of fuel necessitates priming of the metering chamber so that fuel is present to start the engine. A dry metering chamber generally causes the operator to pull on the starting cord several more times than he would if the metering chamber contains a supply of fuel.

Several types of carburetor fuel primers have been suggested in the past and have accomplished the priming of the metering chamber. Typically, these types of primers are of an open loop design. The open loop enables fuel, after the metering chamber is primed, to enter into the atmosphere or to check back into the fuel tank. These open loop designs are entirely dependent upon the check valve sealability at the outlet side of the primer. This is of much concern, since in such devices the metering chamber has direct continuity to the outside atmosphere, which is abnormal to typical diaphragm type carburetor designs. If air is allowed to enter the metering chamber at the outlet point of the primer due to check valve leakage, this will have adverse effect on the normal function of the carburetor. The disadvantages of these types of primers are that the idle fuel mixture becomes lean and results in poor engine acceleration and/or idle stability. Also, in some instances, the air leak will cause the engine to stop running while in the idle mode.

Other types of conventional primer designs provide for a third one way check valve at the metering chamber fuel exit point. This valve feeds the idle system and nozzle high speed system with fuel. This design utilizes high speed nozzle valve, which normally functions in a one way direction, for passage of fuel and adding of the third check valve is considered redundant.

Accordingly, it is an object of the present invention to overcome the disadvantages of the above art. The present invention provides the art with a closed loop carburetor fuel primer. The present invention, due to the sealed closed loop, does not effect the normal functioning of the carburetor. The present invention enables the operator to prime the system without releasing any fuel to atmosphere. Also, the present invention enables fuel to be drawn into the metering chamber through the carburetor fuel inlet system, which is the normal route of the fuel, and the carburetor is not vented to atmosphere which places the carburetor in its normally functioning mode at all times.

The carburetor fuel primer of the present invention is associated with a metering chamber of a carburetor. The metering chamber generally has an inlet and an outlet associated with it. The metering chamber is coupled to a fuel source by the carburetor fuel inlet system, which is the normal fuel path into the carburetor. Also, the metering chamber is associated with the carburetor venturi through primary fuel discharge ports and idling fuel discharge ports. The fuel primer includes a mechanism for enabling restricted one way flow into the metering chamber coupled with the metering chamber inlet. A second mechanism for enabling one way relatively unrestricted flow from the metering chamber is coupled with the metering chamber outlet. A third mechanism for producing pressurized and depressurized flow through the fuel primer is coupled with the first and second mechanisms.

In another embodiment of the present invention the fuel primer includes a plate member secured to the carburetor, by conventional means, covering the metering chamber. A restricted inlet and a relatively unrestricted outlet (or compared with the size of the inlet) are associated with the face of the plate member adjacent to the interior of the metering chamber. A passageway is present in the plate member for coupling the inlet and outlet. A mechanism coupled with the passageway pressurizes and depressurizes flow through the passage way. One way check valves are positioned in the passageway for metering flow into and out of the metering chamber through the restricted inlet and unrestricted outlet, respectively. When the system is pressurized, flow enters the metering chamber through the restricted inlet. With the metering chamber absent of fuel, air will be allowed to flow into metering chamber via the restricted inlet. With the restriction at the inlet, there is very little pressure buildup in the metering chamber, which prevents flow from exiting the nozzle and idle outlet passages.

Upon depressurizing, the flow exits the metering chamber through the primer unrestricted outlet. Since this outlet is unrestricted, a substantial vacuum exists during the depressurizing cycle of the primer system. Therefore, fuel is pulled from the normal fuel inlet passage.

As the primer cycle is repeated several times, most of the air will exit the nozzle and idle ports, while being replaced with fuel. Air (being of considerably less density) will pass the nozzle and idle port during the pressurizing mode of primer, while fuel (being of greater density) will not exit the nozzle and idle ports and will instead flow out the unrestricted outlet. This is accomplished by controlling the amount of pressure buildup in the metering chamber during the pressurization mode at the primer bulb. The pressure control is accomplished by greatly restricting the metering chamber primer inlet.

From the following description and claims taken in conjunction with the accompanying drawings, other objects and advantages of the present invention will become apparent to one skilled in the art.

DETAILED DESCRIPTION OF THE PREFERRED EMBODIMENT

Figure 1:
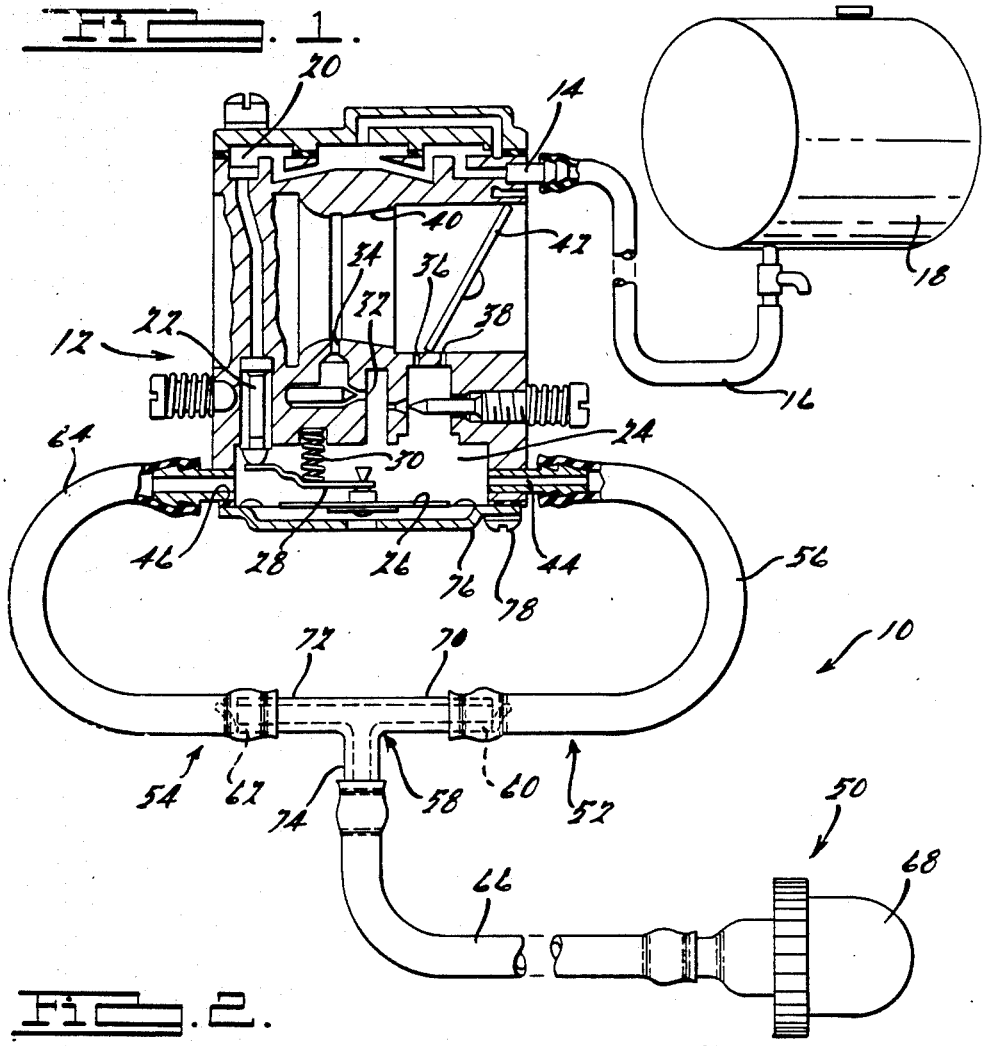
FIG. 1 is a partially cross-section view of a carburetor including a fuel primer in accordance with the present invention.

Referring to FIG. 1, a fuel primer is shown and designated with the reference numeral 10. The fuel primer 10 is associated with a carburetor 12 of a small internal combustion engine. The carburetor 12 is of the butterfly choke type. The present invention operates equally as well with carburetors having a choke as described in U.S. patent application Ser. No. 848,409, filed Apr. 4, 1986, assigned to the same assignee as the present invention, the specification of which is herein incorporated by reference. The carburetor 12 has a fuel inlet 14 connected to a conduit 16 which, in turn, communicates with a fuel tank 18, having a vent to atmosphere. The fuel inlet 14 communicates with a fuel path 20 which passes through the carburetor 12 to a fuel inlet valve 22 which is positioned in the fuel path 20. The fuel inlet valve 22 controls the amount of fuel passing from the fuel path 20 into the metering chamber 24. The fuel inlet valve 22 communicates with a diaphragm 26, linkage member 28, and spring 30 for enabling vacuum pressure to open the inlet valve 22 to control fuel entry into the metering chamber 24. The metering chamber 24 communicates with a fuel take off port 32 which, in turn, is associated with a main fuel discharge port 34 and primary and secondary idle discharge ports 36 and 38. The ports 34, 36 and 38 are associated with a fuel venturi 40 which, in turn, feed a combustion chamber of an engine (not shown). The venturi 40 has a butterfly valve 42 for metering air and fuel flow into the engine combustion chamber.

The metering chamber 24 has a restricted inlet port 44 for enabling flow to enter the metering chamber 24 from the fuel primer 10 and a relatively unrestricted outlet port 46 for enabling flow to pass from the metering chamber 24 into the primer 10. In the disclosed embodiment, the size of the unrestricted outlet port is approximately six times the size of the restricted inlet port.

The primer 10 comprises a pressurizing mechanism 50 associated with a mechanism 52 to cause one way flow into the metering chamber 24 through the restricted inlet port 44. A mechanism 54 enabling one way flow from the metering chamber 24 through the unrestricted outlet port 46 communicates with the first one way flow mechanism 52 and pressurizing mechanism 50.

The first one way flow mechanism 52 includes a conduit 56 coupled with the restricted inlet port 44. A T-connector 58, having a continuous bore through its legs 70, 72, and 74 has a check valve 60 on the first leg 70 to cause one way flow from the primer 10 into the metering chamber 24 through restricted inlet port 44. The second one way flow mechanism 54 includes a second check valve 62, on the second leg 72 of the T-connector 58, for enabling flow from the metering chamber 24, through unrestricted outlet port 46, via conduit 64, to return to the T-connector 58. Once flow returns into the T-connector 58 the check valve 62 will not permit the flow to reverse back into the metering chamber 24 through unrestricted outlet port 46. Thus, the flow either continues through the first leg 70 of the T-connector 58, through the check valve 60, into conduit 56, and back into the metering chamber 24, or the flow passes into the mechanism 50 for providing pressurized flow.

The mechanism 50 for providing the primer with pressurized flow includes a conduit 66 associated with the leg 74 of the T-connector 58 and a resilient bulb 68 associated with the other end of the conduit 66. The resilient bulb 68, generally formed from a conventional rubberized material, enables compression of the fluid in conduit 66 which, in turn, passes through the check valve 60 into the metering chamber 24, as will be described herein.

The primer 10 generally functions as follows. The bulb 68 is depressed, forcing air through conduit 66 into the leg 74 of T-connector 58. The air continues through the first leg 70 of the T-connector 58 through the check valve 60 into conduit 56. The pressurized air continues through restricted inlet port 44 into the metering chamber 24. In the metering chamber 24, the controlled pressurized air, from the bulb 68 travels two paths. Some of the air in the metering chamber 24, being of a lower density than fuel, exits into the venturi 40 of the carburetor via discharge ports 32, 34, 36 and 38. Some of the air in the metering chamber 24 passes out of the unrestricted outlet port 46 through conduit 64, past check valve 62, into the second leg 72 of the T-connector 58. At this time, the air in the second leg 72 of the T-connector 58 may continue to pass into the first leg 70 of the T-connector 58 and through the check valve 60 into conduit 56 and continue flowing in a continuous loop, as described. Also, the air may pass back into the leg 74 of the T-connector 58 into the bulb 68 as the bulb 68 retracts to its original position. When the bulb 68 is released from its depressed position, the primer 10 becomes depressurized such that a substantial vacuum is created in the system. This substantial vacuum causes air to be further drawn from the metering chamber 24 through unrestricted outlet 46, into conduit 60, through check valve 62, and back into the bulb 68. As this occurs, a substantial vacuum is created in the metering chamber 24. This substantial vacuum in the metering chamber 24 causes the diaphragm 26 to be activated which, in turn, activates linkage member 28 and spring 30 to activate the fuel inlet valve 22 and enable fuel from fuel tank 18 to be drawn into the metering chamber 24 via fuel path 20.

It should be noted that the bulb 68 can be depressed and permitted to expand several times in a very brief period. Thus, fuel can be drawn into the metering chamber 24 in a relatively short perior of time .Once the metering chamber is presented with fuel, additional depressions of the bulb 68 will only force fuel around the continuous loop formed by the flow mechanisms 52, 54 and 50 and the chamber 24. With fuel present in the metering chamber 24, the carburetor 12 is primed for start up of the internal combustion engine.

Figure 2:
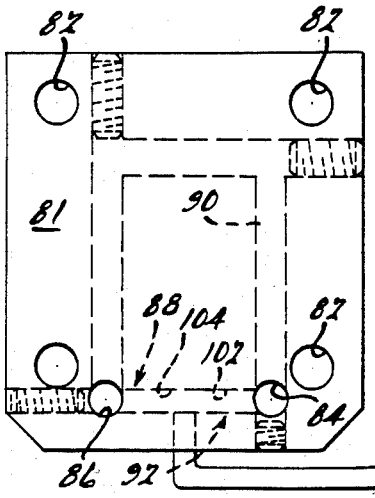
FIG. 2 is a top plan view of an alternative embodiment of a fuel primer in accordance with the present invention.
Figure 2:
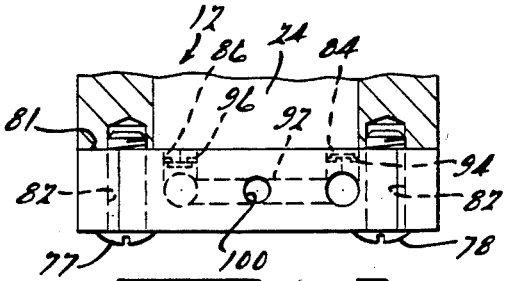
Figure 3:
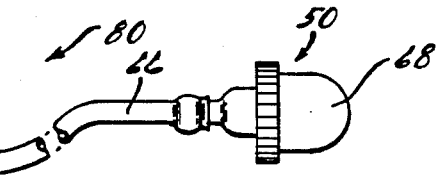
FIG. 3 is a side view of FIG. 2.

Turning to FIGS. 2 and 3, a second embodiment of the present invention is illustrated. In this embodiment, the cover plate 76 of the carburetor 12 in FIG. 1 is removed, exposing the diaphragm 36 and metering chamber 24. The plate member 80 is positioned and secured to the carburetor 12 by a plurality of screws 77 and 78 in place of the cover plate 76 and the restricted inlet port 44 and unrestricted outlet port 46 are eliminated. The plate member 80, which will be described herein, functions the same as the primer 10, described above.

The plate member 80 may be manufactured from any suitable metallic or plastic material. The plate member has a plurality of apertures 82 for enabling passage of the screws 77 and 78. The plate member 80 has a restricted inlet port 84 and a relatively unrestricted outlet port 86 on face 81 to enable flow to enter and exit the metering chamber 24, respectively. The plate member 80 further comprises a passageway 88 which includes a loop 90, which communicates the restricted inlet port 84 with the unrestricted outlet port 86, and a passag 92, which communicates the restricted inlet port 84 and unrestricted outlet port 86 with a mechanism 50 for pressurizing and depressurizing the primer, as described above. A check valve 94, positioned in the restricted inlet port 84, enables one way flow to enter into the metering chamber 24. A second check valve 96, positioned to the unrestricted outlet port 86, enables one way flow to exit the metering chamber 24 into the passageway 88 and loop 90.

As described above, the pressurizing/depressurizing mechanism is activated which, in turn, forces pressurized air into the lg 100 of the T-shaped passage 92. The pressurized air passes along the first leg 102 of the passage 92 toward the restricted inlet check valve 94 to enable the flow to enter into the metering chamber 24. In the metering chamber 24, some of the pressurized air flow exits the metering chamber 24 through the discharge ports 32, 34, 36 and 38, as explained above, while most of the air flow exits the metering chamber 24 through the unrestricted outlet port 84 through one way outlet check valve 96. At this time, the flow may either continue around the loop 90 and return into the metering chamber 24, through check valve 94 and restricted inlet port 84, or pass back into passage 92, returning into the pressurizing mechanism 50 or back into the metering chamber 24. As the pressurizing mechanism 50, returns to its normal position, air flow is drawn from the metering chamber 24 through unrestricted outlet port 86 and check valve 96, which, in turn, enables fuel to enter into the metering chamber 24 due to the diaphragm contraction, as described above.

While the above summarizes the present invention, it will become apparent to those skilled in the art that modifications, variations, and alterations may be made including varying length of channels, without deviating from the scope and fair meaning of the subjoined claims.

What is claimed is:

1. A fuel primer for a carburetor having a metering chamber, the metering chamber having an inlet and an outlet, and being coupled with a fuel source and a combustion path, the primer comprising:

first means coupled with said inlet for enabling one way flow into said metering chamber through said inlet;

second means coupled with said outlet for enabling one way flow from said metering chamber through said outlet; and third means coupled with said first and second means for introducing flow through said primer, said first, second and third means forming a flow loop remote from said fuel source and said flow from said third means circulating through said first, second and third means such that fuel is drawn into said metering chamber from said fuel source.

2. The primer according to claim 1 wherein said first means includes a one way check valve for enabling flow to enter into said metering chamber through said inlet.

3. The primer according to claim 2 wherein said second means includes a one way check valve for enabling flow to exit said metering chamber through said outlet.

4. The primer according to claim 3 wherein said third means includes a resilient bulb member for pressurizing said primer upon compression of said bulb and for depressurizing said primer upon expansion of said bulb.

5. The primer according to claim 4 wherein upon compression of said bulb, pressurized flow is forced into said metering chamber through said inlet with continued flow out of said metering chamber through said outlet.

6. The primer according to claim 5 wherein upon expansion of said bulb, the flow is depressurized drawing additional flow from said metering chamber through said outlet such that the metering chamber is depressurized which, in turn, draws fuel into the metering chamber from said fuel source.

7. An internal combustion engine including a carburetor, the carburetor including a metering chamber having an inlet and an outlet, said carburetor being coupled with a fuel source and a combustion path, and a primer associated with said carburetor comprising:

first means coupled with said inlet for enabling flow into said metering chamber through said inlet;

second means coupled with said outlet for enabling flow from said metering chamber through said outlet; and third means coupled with said first and second means for introducing flow through said primer, said first, second and third means forming a flow loop remote from said fuel source and said flow from said third means circulating through said first, second and third means such that fuel is drawn into said metering chamber from said fuel source.

8. The internal combustion engine according to claim 7 wherein said first means includes a one way check valve for enabling flow to enter into said metering chamber through said inlet.

9. The internal combustion engine according to claim 8 wherein said second means includes a one way check valve for enabling flow to exit said metering chamber through said outlet.

10. The internal combustion engine according to claim 9 wherein said third means includes a resilient bulb member for pressurizing said primer upon compression of said bulb and for depressurizing said primer upon expansion of said bulb.

11. The internal combustion engine according to claim 10 wherein upon compression of said bulb pressurized flow is forced into said metering chamber through said inlet with continued flow out of said metering chamber through said outlet.

12. The internal combustion engine according to claim 11 wherein upon expansion of said bulb the flow is depressurized, drawing additional flow from said metering chamber through said outlet such that the metering chamber is depressurized which, in turn, draws fuel into the metering chamber from said fuel source.

* * * * *